United States Patent [19]

Selberg

[11] 4,337,899

[45] Jul. 6, 1982

[54] HIGH PRESSURE LIQUID JET NOZZLE SYSTEM FOR ENHANCED MINING AND DRILLING

[75] Inventor: Bruce P. Selberg, Rolla, Mo.

[73] Assignee: The Curators of the University of Missouri, Columbia, Mo.

[21] Appl. No.: 124,061

[22] Filed: Feb. 25, 1980

[51] Int. Cl.[3] ..... B05B 1/26; B05B 1/34; E21B 7/18

[52] U.S. Cl. ..... 239/543; 175/422; 239/590.5

[58] Field of Search ..... 239/1, 11, DIG. 1, 543-545, 239/589, 590, 590.5, 536; 175/67, 422

[56] References Cited

U.S. PATENT DOCUMENTS 4,151,955 5/1979 Stouffer ..... 239/590
4,231,519 11/1980 Bauer ..... 239/589

OTHER PUBLICATIONS

Koski, W. S. et al., "Fast Jets From Collapsing Cylinders", *Journal of Applied Physics,* vol. 23, No. 12, Dec. 1952, pp. 1300-1305.

Walsh, J. M. et al., "Limiting Conditions for Jet Formation in High Velocity Collissions", *Journal of Applied Physics,* vol. 24, No. 3, Mar. 1953, pp. 349-359.

Dunne, B. et al., "Some Phenomena Associated With Supersonic Liquid Jets", *Journal of Applied Physics,* vol. 25, No. 5, May 1954, pp. 569-572.

Crane, L. S. et al., "The Effect of Mechanical Vibration on the Break-Up of a Cylindrical Water Jet in Air", *British Journal of Applied Physics,* vol. 15, 1964, pp. 743-750.

Dabora, E. K., "Production of Monodisperse Sprays", *The Reveiw of Scientific Instruments,* vol. 38, No. 4, Apr. 1967, pp. 502-506.

Bowles Engineering Corporation, for U.S. Department of Transportation, "A Study of External Augmentation of the Velocity of Fluid Jets", (R-12-21-67 Contract No. 7-35380).

Mazurkiewicz et al., "Adaptation of Jet Accumulation Techniques for Enhanced Rock Cutting", ASTM *Conference on Erosion: Prevention and Useful Applications,* Vail, Colorado, Oct. 24-26, 1977.

Lord Rayleigh, F. R. S., "On The Instability of Jets", London Mathematical Society, vol. 10, No. 4, 1898, pp. 4-13.

*Primary Examiner*—Andres Kashnikow
*Attorney, Agent, or Firm*—Ray E. Snyder

[57] ABSTRACT

This invention is directed to a nozzle configuration capable of enhancing the cutting and drilling effects of high pressure liquid fluid jets. The jet system is particularly adapted to configurations of two or more liquid jets which are oriented to converge at a common point. The internal nozzle configuration produces controlled instability in the jet stream causing a more rapid breakup into droplets which can be combined to produce very fast moving jets and slow moving jets when collision between droplets occur. The velocity of the fast jets so formed may be several times greater than the original velocity of the droplets upon emergence from the nozzle orifices. The interiors of the nozzles are formed with circumferential grooves or protrusions which produce perturbations in the jet streams causing rapid break-up into droplets.

14 Claims, 4 Drawing Figures

HIGH PRESSURE LIQUID JET NOZZLE SYSTEM FOR ENHANCED MINING AND DRILLING

BACKGROUND OF THE INVENTION

1. Field of the Invention

This invention relates generally to the field of boring and penetrating the earth, and more particularly to methods and apparatus for boring by fluid erosion.

2. Description of the Prior Art

High pressure water jets have been used in the continuous mode for drilling through rock or other hard material, as exemplified by the patent to Summers U.S. Pat. No. 4,119,160. High pressure water jets have also been used in the long wall mining of coal by using continuous jets mounted so as to oscillate in a plane. A device of this general type is exemplified by the application to Barker et al Ser. No. 894,769 filed Apr. 10, 1978 now U.S. Pat. No. 4,265,487 issued May 5, 1981.

Intermittent high pressure water jets for drilling are also known and exemplified by the patent to Hall et al U.S. Pat. No. 3,927,723 entitled "Apparatus for Drilling Holes Utilizing Pulsed Jets of Liquid Charge Material" and also the patent to Cooley U.S. Pat. No. 3,520,477 entitled "Pneumatically Powered Water Cannon".

Each of the devices described in the two above patents is capable of producing intermittent or pulsed water jets of very high velocity. The cutting capability of the pulsed jets are determined solely by the energy imparted by an activating piston. Pressure pulses formed in this manner are reflected back into the system and have a destructive effect on the equipment.

Scientific studies of shaped explosive charges have shown that fast jets of metallic liquids are formed in the collapse of such charges. The velocity achieved is a function of the charge size and shape and material composition of the liner which upon collapse, will create the cutting jet. Examples of such studies are:

1. Koski, W. S., F. A. Lucy, R. G. Shreffler, and F. J. Willig, "Fast Jets from Collapsing Cylinders," *Journal of Applied Physics,* Vol. 23, No. 12, December 1952.
2. Walsh, J. M., R. G. Shreffler, and F. J. Willig, "Limiting Conditions for Jet Formation in High Velocity Collisions," *Journal of Applied Physics,* Vol. 24, No. 3, March 1953.
3. Dunne, B. and B. Cassen, "Some Phenomena Associated with Supersonic Liquid Jets," *Journal of Applied Physics,* Vol. 25, No. 5, May 1954.

The jets so produced and described in these studies are transient and are not produced on a continuous basis. This limits their possible fields of application, e.g. to the perforation of well casings, and the like.

Scientific studies have also been made of fluid streams and their break-up into droplets. These latter studies are exemplified by:

4. Crane, L., S. Birch, and P. D. McCormack, "The Effect of Mechanical Vibration on the Break-up of a Cylindrical Water Jet in Air," *Journal of Applied Physics, Vol.* 15, 1964.
5. Dabora, E. K., "Production of Monodisperse Sprays," *The Review of Scientific Instruments,* Vol. 38, No. 4, April 1967.

The external augmentation of the velocity of fluid jets has also been studied and reported by the Bowles Engineering Corporation in 1967 in a report to the Department of Transportation (R-12-21-67, Contract No. 7-35380). This study had to do with the impacting of two relatively slow-moving slugs of water to produce a very small but effective fast jet. The work described combined individual fluid slugs and was done on a cyclical rather than continuous basis.

The phenomenon of "accumulative effect" has been employed in a continuous system as reported by Mazurkiewicz et al.: Adaptation of Jet Accumulation Techniques for Enhanced Rock Cutting, ASTM Conference on Erosion: Prevention and Useful Applications, Vail, Colo., Oct. 24–26, 1977.

It is also known that the break-up into droplets of a stream of flowing liquid can be accelerated if it is excited at a particular frequency. The frequency at which a fluid stream is most unstable is commonly referred to as the Rayleigh instability frequency and was first reported by J. W. S. Rayleigh proceedings of London Mathematical Society, Volume 10, No. 4, 1878.

SUMMARY OF THE INVENTION

It is an object of the present invention to provide an improved nozzle structure which will excite the fluid stream passing through the nozzle in a frequency range where the jet is most unstable so as to produce an accelerated break-up of the stream.

It is an additional object to provide the improved nozzle structure that is effective in breaking-up the stream of fluid emitting from the nozzle exit in a simple and controlled manner.

It is an additional object to employ two or more converging jets which have been broken up into discreet droplets or "slugs" which can be recombined in a quasi-continuous manner to produce a very high velocity fluid jet. For a particular liquid jet, such as water flowing into air, the instability frequency is predominantly a function of the liquid fluid density, the jet radius, a liquid surface tension, and the jet velocity. Yet it is contemplated that a particular placement of pattern for the grooves or protrusions employed may be utilized to accommodate for the variable defined in a particular nozzle with a particular fluid. The combination of grooves and/or protrusions employed will here and after be referred to as "boundry layer exciters," (BLE). It is contemplated for each particular nozzle shape and exit diameter the BLE will have to be located in such a pattern as to insure a constant frequency of exitation. In addition, it is contemplated, that for each operating pressure or resultant jet velocity, a particular BLE pattern will be required. Replacement nozzles with different patterns would be available for differing operating conditions.

DETAILED DESCRIPTION OF THE PREFERRED EMBODIMENT

Figure 1:
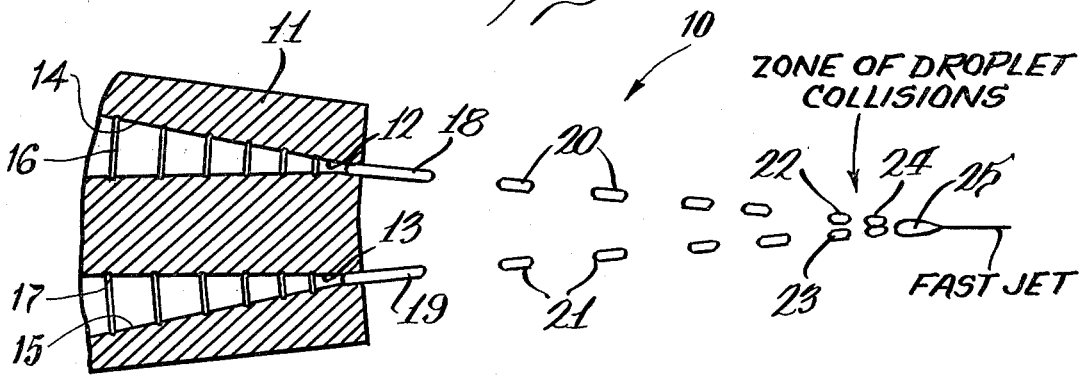
FIG. 1 is a longitudinal sectional view of a nozzle having a pair of converging liquid jets and formed with internal grooves or protuberances.

The improved jet nozzle design of the present invention is illustrated in FIG. 1 and is designated generally by the numeral 10. The nozzle 10 comprises a generally cylindrical body portion 11 formed with two jet orifices 12 and 13. Converging longitudinal channels 14 and 15 are formed in the body portion 11 and terminate at the orifices 12 and 13. A plurality of transverse circular grooves or protuberances 16 and 17, respectively, are formed on the interior walls of the channels 14 and 15. The groove instability process is enhanced if the surface finish of the interior channels 14 and 15 is significantly less than the boundary layer thickness. The grooves or protuberances 16 and 17 lie at right angles to the direction of fluid flow through the channels 14 and 15 and will hereinafter be referred to as "boundary layer exciters" (BLE).

In operation, the liquid jets emerging from orifices 12 and 13 are moving at very high velocity. In a conventional nozzle, these jets are coherent for a considerable distance after leaving the nozzle orifices. In this invention, the BLE's 16 and 17 perturb or excite the fluid stream in the boundary layer inside the nozzle at some frequency so that the stream begins to break up into discreet slugs at 18 and 19 immediately or soon after emergence from the nozzle orifices 12 and 13. The axial spacing of the grooves or protuberances 16 and 17 are such as to excite the fluid stream, preferably at the frequency at which the stream is most unstable. This is commonly called the Rayleigh instability frequency referred to above. The aerodynamic forces shape the slugs into droplets 20 and 21 which continue to move at substantially the exit velocity and at 22 and 23 are nearly merged together. At point 24, the droplets collide to form a fluid "slug" and at point 25 forms a fast jet having a velocity greater than the velocity of the individual droplet streams. The resultant fast slugs are formed almost continuously by the merging of successive droplets 22 and 23, thereby creating a quasi-continuous jet of fast slugs. The grooves and/or protuberances can be formed in each channel so as to insure that the droplets arrive at point 24 concurrently.

For a particular liquid jet, such as water flowing into air, the instability frequency for the streams is predominantly a function of the liquid fluid density, the jet radius, the liquid surface tension, and the jet velocity. Thus for different nozzle geometries, exit diameters, and jet velocities, different grooves/protrusion placements are required to accommodate a range of pressures and exit velocities. Expressed differently, for each particular nozzle shape and exit diameter, the BLE's will have to be located in a particular pattern to insure the constant frequency excitation. It is contemplated that the size and location of the BLE's will be predetermined for each predetermined nozzle shape and intended fluid exit velocity. The exit velocity can be established or controlled by the accelerating pressure supplied by a pumping source (not shown). The fast slugs so developed, take a shape which is pointed, thereby enhancing their penetration capability in a typical material. These resulting shaped fast slugs will penetrate and cut material at a faster rate. Alternatively, an equivalent cutting rate could be obtained utilizing the fast slugs obtained from the appropriate lower pressures driving pressure.

Figure 2:
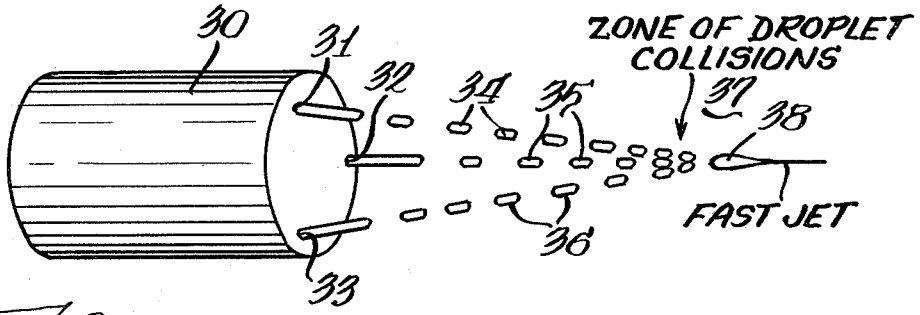
FIG. 2 is a perspective external view of a nozzle having three converging liquid jets.

Referring to FIG. 2, there is illustrated an alternative embodiment of a nozzle having three or more converging jets. The nozzle 30 illustrated is formed with orifices 31, 32 and 33. The streams emerging from the orifices are excited in the same manner as described in FIG. 1 and the stream promptly breaks up into droplets 34, 35, and 36 which converge toward a zone 37 and form a fast jet at 38. As above, simultaneous convergence of the drops is dictated by proper placement of the starting grooves. This configuration of the jet imparts a greater mass of fluid toward the focal point 37 and hence imparts a greater cutting capability of the fast jets 38.

Figure 3:
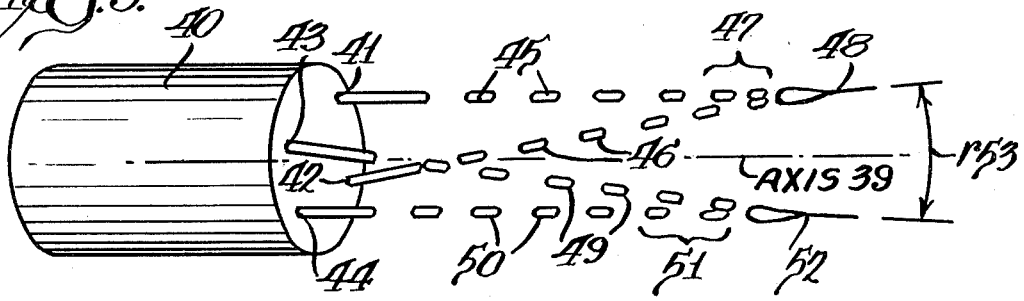
FIG. 3 is a perspective view of a nozzle having two pairs of converging liquid jets.

Referring to FIG. 3, there is illustrated still another embodiment showing two pairs of converging jets on opposite sides of a longitudinal central axis 39. The nozzle tip 40 has orifice pairs 41 and 42, and 43 and 44. Fluid streams emerging from orifices 41 and 42 break up into slugs or droplets 45 and 46 and converge in a zone 47 to form a fast jet at 48. Similarly, the jets emerging from orifices 43 and 44 break up into slugs or droplets 49 and 50 converging in the zone 51 and forming a fast jet at 52. The direction of travel of the resultant fast slugs 48 and 52 define a particular angular separation 53. This embodiment of the nozzle 40 is particularly adapted for cutting a slot through coal or other geologic material.

As indicated above, J. W. S. Rayleigh predicted that a fluid stream could be broken up into droplets when excited at a particularly frequency. He derived a formula to add some mathematical precision to a prediction of the maximum stability frequency. However, it should be noted that the velocities of the fluid streams considered by Rayleigh were very low compared to the velocities encountered in the present invention. Also he did not include a consideration of viscosity effects, or surface tension and the like.

An example of a fluid jet system to which Rayleigh's analysis might be applied is the following: Consider a nozzle with an exit diameter, or exit diameters if multiple orifices are used, of 0.043 inches. For a stagnation pressure of 8,930 psi, and using water as the fluid of choice, the theoretical exit velocity of the stream would be 1,148 ft/sec. Rayleigh's analysis predicts that to obtain the maximum instability within the jet stream, the frequency of excitation should be $$f = \frac{V_j}{4.058 d_j}$$

where $V_j$ is the jet velocity and $d_j$ is the jet diameter. According to Rayleigh's formula the wave length of the disturbance can be expressed as:

$$L_j = 4.058 \sqrt{\frac{4\dot{m}}{\pi \rho V_j}}$$

where $L_j$ is the wave length of disturbance, m is the mass flow rate of the jet, and $\rho$ is the density of the jet.

In the above example, Rayleigh's analysis predicts a $L_j$, or groove placement, in the region of the exit orifice, where the velocity is near 1,148 ft/sec., or every 0.174 inches. Thus a protuberance or groove 16 or 17 can be placed every $L_j$ distance in this region.

A more precise analysis which includes viscosity effects has been developed by Weber which predicts maximum instability when:

$$L_j = 15.7 \sqrt{\frac{4\dot{m}}{\pi \rho V_j}}$$

This formula indicates that grooves or protuberances 16 or 17 should be placed every 0.653 inches near the exit orifice for the same conditions defined above. The placement of grooves would theoretically promote the greatest jet instability. Other groove placement would also promote instability but to a lesser extent according to the theoretical analysis. However, as described above, analysis to date has not considered such high pressures and high velocities.

As the nozzle diameter increases within the channels 14 and 15 upstream from the exit orifices 12 and 13 respectively, the groove placement should be farther apart. Furthermore, if a supply conduit is connected to the nozzle 11 upstream of the nozzle, then these grooves or/and protuberances 16 and 17 can be formed in the pipe itself. For example, for a pipe having an inside diameter of 0.375 inches Rayleigh's analysis predicts a groove placement every 1.5 inches. Weber's analysis indicates a groove placement of 5.9 inches. The height of the protuberances or the depth of the grooves should be small enough so as not to cause long delay or separation of the flowing fluid. An upper limit on these protuberances or grooves would be the thickness or height of the boundary layer. Heights or grooves less than the boundary layer thickness should be most efficient. The actual boundary layer thickness is dependent on upstream nozzle flow conditions, nozzle geometry, and supply geometry and hence must be solved for in each particular nozzle supply pipe application.

The nozzle system of the present invention using the BLE's 16 and 17 can also be used to advantage to excite non-converging fluid jets in order to cause break up into droplets for cutting or impinging on certain types of materials with a cavitation effect. However, the provision of the BLE's 16 and 17 are particularly advantageous in a system utilizing converging jets so that the continuous fast jet effect can be employed to greater advantage. Grooves and/or protuberances could in addition be placed in the interior of the supply conduit upstream of the nozzle for added BLE excitation.

Figure 4:
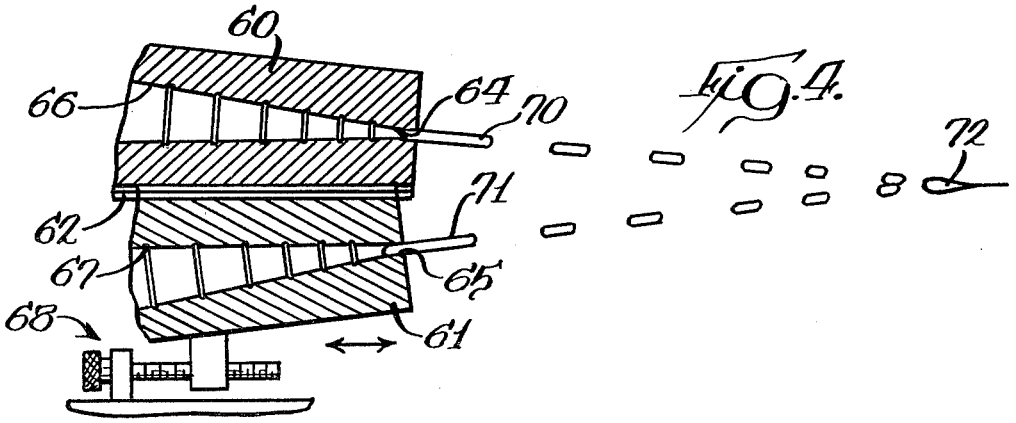
FIG. 4 is a longitudinal sectional view of a dual jet nozzle system in which the jets are adjustable longitudinally.

Referring now to FIG. 4 there is illustrated a modified dual jet structure in which the nozzle jets are movable longitudinally relative to each other. The nozzle body is divided longitudinally into two halves 60 and 61 and may be interlocked by means of a dove-tail track 62. The body half 60 is formed with a nozzle jet orifice 64 and a tapered internal conduit 66. Similarly, the body half 61 is formed with a jet orifice 65 and tapered internal conduit 67. The conduits 66 and 67 may be formed with internal BLEs as previously described.

A micrometer screw structure 68 may be attached to the body 61 for causing it to move longitudinally along the track 62 relative to the body 60. This relative movement can permit adjustment of the jet streams 70 and 71 that emerge from the orifices 64 and 65, respectively, so that the droplets collide precisely at the desired point 72. A strobe light (not shown) may be employed to effectively tune the two streams to collision precisely at the point 72.

In summary, the velocity of each fast slug can be increased, depending on the converging angle, by as much as an order of magnitude over the continuous jet from the same nozzle and under the same conditions.

Secondly, due to the increased jet velocity and the shape of the slug, the material removal rates are increased utilizing the quasi-steady or intermittent shaped fast slug jets in comparison with a steady state jet from the same nozzle at the same stagnation pressure.

A third advantage in utilizing the present system is that the same amount of material can be removed at lower supply pressures than with a continuous jet. Most of the momentum and cutting is accomplished by the fast jet because of its higher velocity. The slow jet may, in some circumstances, actually have a negative velocity.

Still another advantage lies in the fact that the BLE jet excitation process described herein is possible with no moving parts and hence, with a minimum of reliability problems.

A high velocity stream is degraded in air and the fact that the break-up can be controlled permits droplet collison in a shorter distance than might otherwise be attainable.

It is to be understood that the embodiments shown and described are the preferred ones and that many changes and modifications may be made thereto without departing from the spirit of the invention. The invention is not to be considered as limited to these embodiments except insofar as the claims may be so limited.

I claim:

1. A high pressure fluid jet system adapted for use in cleaning, cutting and drilling comprising:

a nozzle body formed with at least one internal tapered conduit connected at one end to be supplied from a source of high pressure fluid and terminating at its other end at a jet exit orifice through which a first high velocity linear jet stream is expelled which impinges at a point; and passive means formed within said nozzle body for causing said linear jet stream to break into droplets in a controlled manner.

2. The fluid jet system of claim 1 wherein:

said passive means includes internal structure formed within said tapered conduit effective to excite the fluid stream moving therethrough at some desired frequency to thereby cause the rapid break-up of said expelled linear stream into droplets.

3. The fluid jet system of claim 2 wherein:

said passive means is a plurality of circular grooves formed on the internal walls of said tapered conduit transversely to the direction of flow of said stream.

4. The fluid jet system of claim 2 wherein:

said passive means is a plurality of raised circular protuberances formed on the internal walls of said tapered conduit transversely to the direction of flow of said stream.

5. A fluid jet system of claims 3 or 4 wherein:

said circular grooves or protuberances are displaced longitudinally from each other according to a mathematical formula so as to excite said stream at a desired frequency.

6. The fluid jet system of claim 5 wherein:

said exciting frequency is approximately equal to the stream's natural instability frequency.

7. The fluid jet system of claim 1 wherein:

said nozzle body is formed with a second tapered conduit also connected to be supplied from said high pressure source and terminating at a second jet orifice through which a second high velocity jet is expelled;

said second conduit also being formed with said passive means; and said jet orifices being oriented to cause said jet streams to be directed to a common point of convergence.

8. The fluid jet system of claim 7 wherein:
fluid droplets of each of said jet streams are caused to collide to produce two new streams of discrete fluid slugs with different velocities.

9. The fluid jet system of claim 8 wherein:
one of said new streams has a velocity significantly higher than the velocity of said original jet streams.

10. The fluid jet system of claim 7 wherein:
said nozzle body is separated into two parts whereby said jet orifices are movable longitudinally relative to each other to ensure precise collision of droplets from each of said streams.

11. The fluid jet system of claim 10 including:
means attached to said nozzle body for causing longitudinal movement of one jet orifice with respect to the other.

12. The fluid jet system of claim 11 wherein:
said attached means is a micrometer screw.

13. The fluid jet system of claim 7 including:
a nozzle body having a central longitudinal axis lying generally parallel to a first plane defined by said expelled jet streams;
said nozzle body being formed with a second pair of jet orifices oriented to collide at a second point of convergence and lying in a second plane defined by said expelled jet streams;
said second plane being generally parallel to said first plane and lying on an opposite side of said axis therefrom.

14. The fluid jet system of claim 13 wherein:
said planes are slightly divergent with respect to said axis.

* * * * *